US006709034B2

(12) United States Patent
Michael

(10) Patent No.: US 6,709,034 B2
(45) Date of Patent: Mar. 23, 2004

(54) SLIDING DOOR HANDLE HAVING AN INTEGRAL PUSH BUTTON LOCKING MECHANISM

(76) Inventor: Alex Michael, 162 Torrey Pines Dr., Toms River, NJ (US) 08757

( * ) Notice: Subject to any disclaimer, the term of this patent is extended or adjusted under 35 U.S.C. 154(b) by 0 days.

(21) Appl. No.: 10/191,869

(22) Filed: Jul. 10, 2002

(65) Prior Publication Data

US 2004/0007885 A1 Jan. 15, 2004

(51) Int. Cl.[7] ..... E05B 3/00

(52) U.S. Cl. ..... 292/336.3; 292/DIG. 46; 292/DIG. 37; 292/169.18; 292/150; 292/180

(58) Field of Search ..... 292/336.3, 358, 292/359, 169.18, 169.15, 169.14, DIG. 46, 150, 180, DIG. 37; 70/95, 99, 100; 16/412; 49/460, 449, 503

(56) References Cited

U.S. PATENT DOCUMENTS 2,720,408 A * 10/1955 Krupicka ..... 292/169.18
3,995,349 A * 12/1976 Roberts et al. ..... 16/412
4,179,143 A * 12/1979 Shy ..... 292/179
4,341,043 A * 7/1982 Yamamoto et al. ..... 49/449
4,497,514 A * 2/1985 Moriya et al. ..... 292/336.3
5,029,917 A * 7/1991 Szerlag et al. ..... 292/347
5,084,940 A * 2/1992 Loffler et al. ..... 16/412
5,593,193 A * 1/1997 Heim ..... 292/336.3
5,605,363 A * 2/1997 Kapes ..... 292/196
5,624,141 A * 4/1997 Kuo et al. ..... 292/165
5,941,108 A * 8/1999 Shen ..... 70/467
6,036,243 A * 3/2000 Blom ..... 292/336.3
6,179,352 B1 * 1/2001 Schneeberger ..... 292/347
6,364,383 B1 * 4/2002 Shen ..... 292/357
6,401,302 B1 * 6/2002 Josserand et al. ..... 16/444

* cited by examiner

*Primary Examiner*—Robert J. Sandy
*Assistant Examiner*—Dinesh N Melwani

(57) ABSTRACT

There is provided an improved sliding door handle assembly having a spring operated integral push button locking mechanism. Specifically, the improved sliding door handle assembly is comprised of a handle assembly including an upper handle section and a lower handle section, and a push button assembly. The upper handle section is recessed so as to incorporate the push button assembly and includes an opening for insertion of a cylindrical locking pin. The locking pin is spring-biased so as to move between a first position for locking the handle and a second position for unlocking the handle. The lower handle section is curved to facilitate gripping the door handle. The push button assembly includes a housing member and a push button member. The push button assembly has an opening to receive a push button member that is movable so as to engage and disengage the locking pin for locking and unlocking the handle.

1 Claim, 5 Drawing Sheets

SLIDING DOOR HANDLE HAVING AN INTEGRAL PUSH BUTTON LOCKING MECHANISM

FIELD OF INVENTION

The present invention relates to an improved sliding door handle having an integral push button locking mechanism.

BACKGROUND OF THE INVENTION

Sliding doors are often locked by complex locking mechanisms that comprise many internal moving parts and thus are subject to disrepair. Also, the frame of sliding doors are not of a sufficient size to receive large and secure locking mechanisms. Therefore, there is a need for a mechanism to lock sliding doors that is secure, ergonomically efficient, simple to use, and requires only a minimal number of internal moving parts to withstand everyday wear and tear.

It is an object of the present invention to provide a sliding door handle having an integrated push button locking mechanism that is secure, efficient, durable, and easy to use.

SUMMARY OF THE INVENTION

The present invention provides an improved sliding door handle assembly having a spring operated integral push button locking mechanism. Specifically, the improved sliding door handle assembly is comprised of a handle assembly including an upper handle section and a lower handle section, and a push button assembly. The upper handle section is recessed so as to incorporate the push button assembly and includes an opening for insertion of a cylindrical locking pin. The locking pin is spring-biased so as to move between a first position for locking the handle and a second position for unlocking the handle. The lower handle section is curved to facilitate gripping the door handle.

The push button assembly includes a housing member and a push button member. The housing member has an opening to receive a push button member that is movable so as to engage and disengage the locking pin for locking and unlocking the handle.

DETAILED DESCRIPTION OF THE PREFERRED EMBODIMENT

FIGS. 1 through 7 show an improved sliding door handle 50 having a handle assembly 10 and push button assembly 40.

Figure 1:
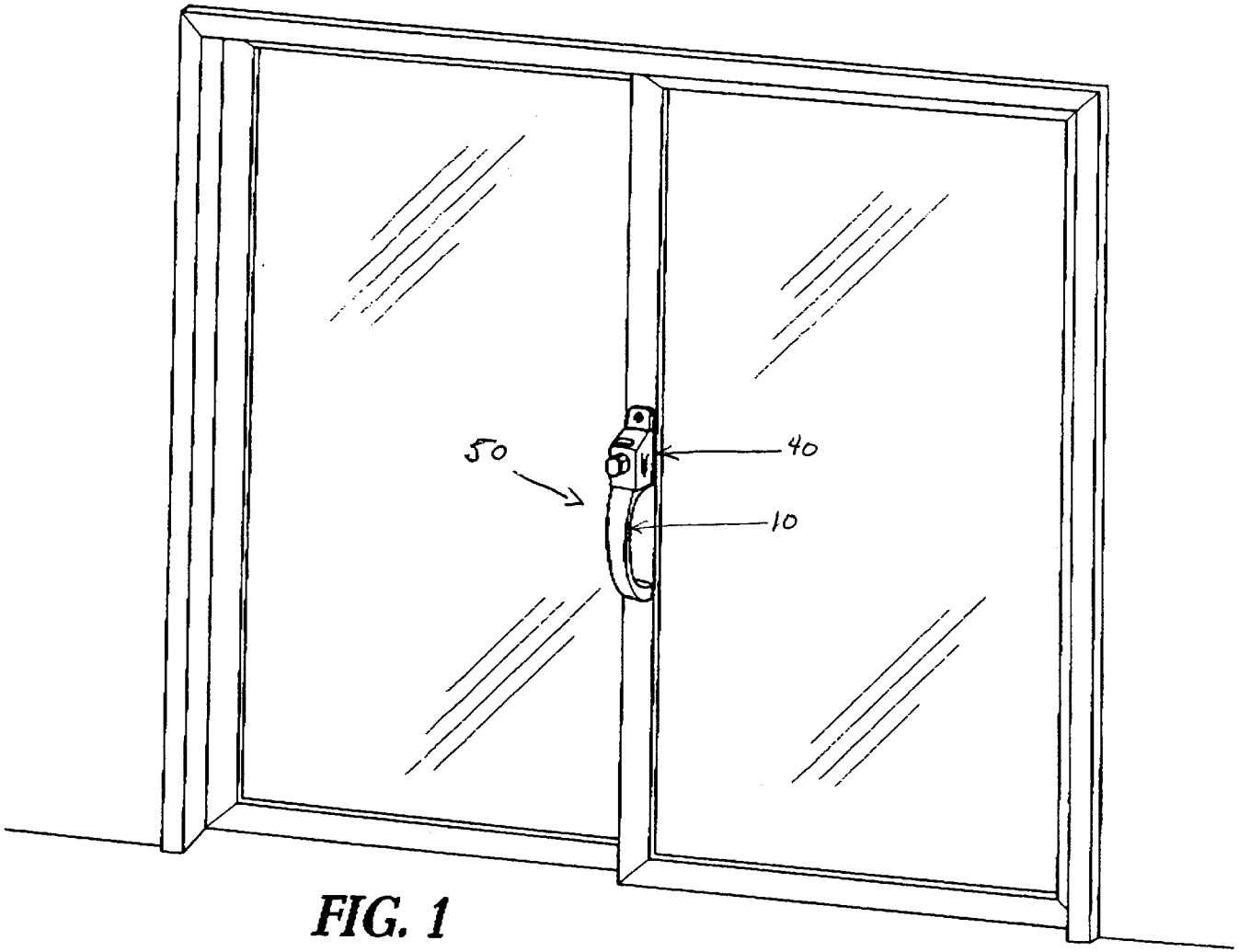
FIG. 1 is a perspective view of an improved sliding door handle, and sliding doors.
Figure 2:
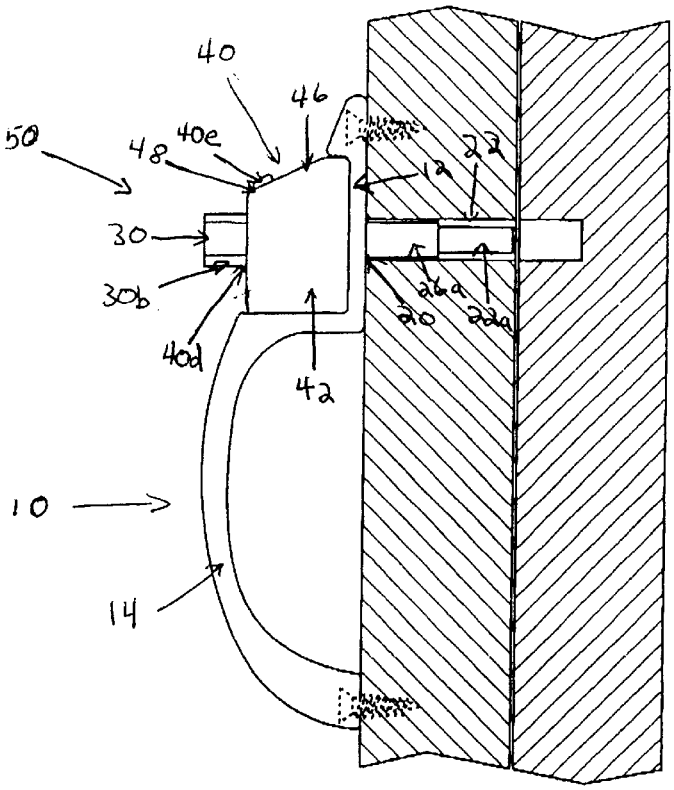
FIG. 2 is a cross sectional view of an improved sliding door handle.
Figure 3:
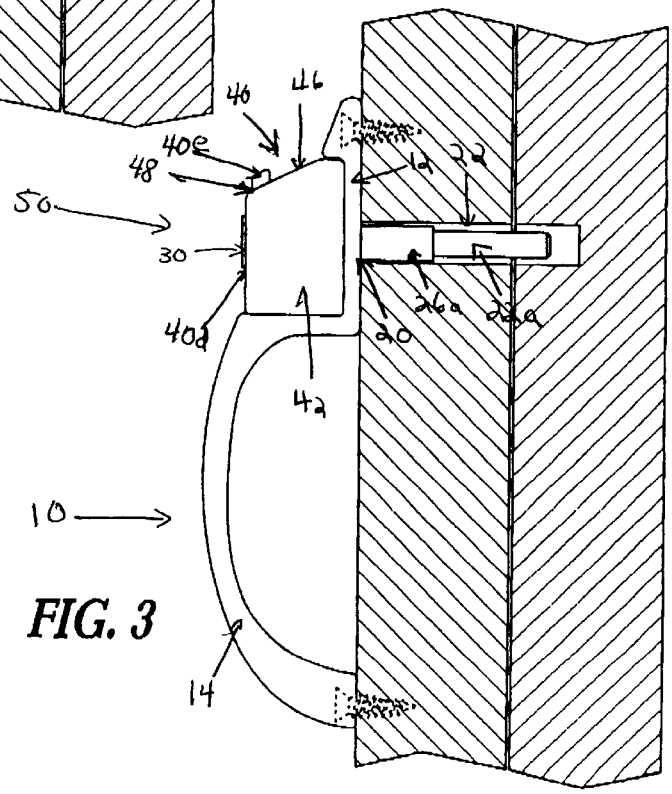
FIG. 3 is a cross sectional view of an improved sliding door handle.
Figure 4:
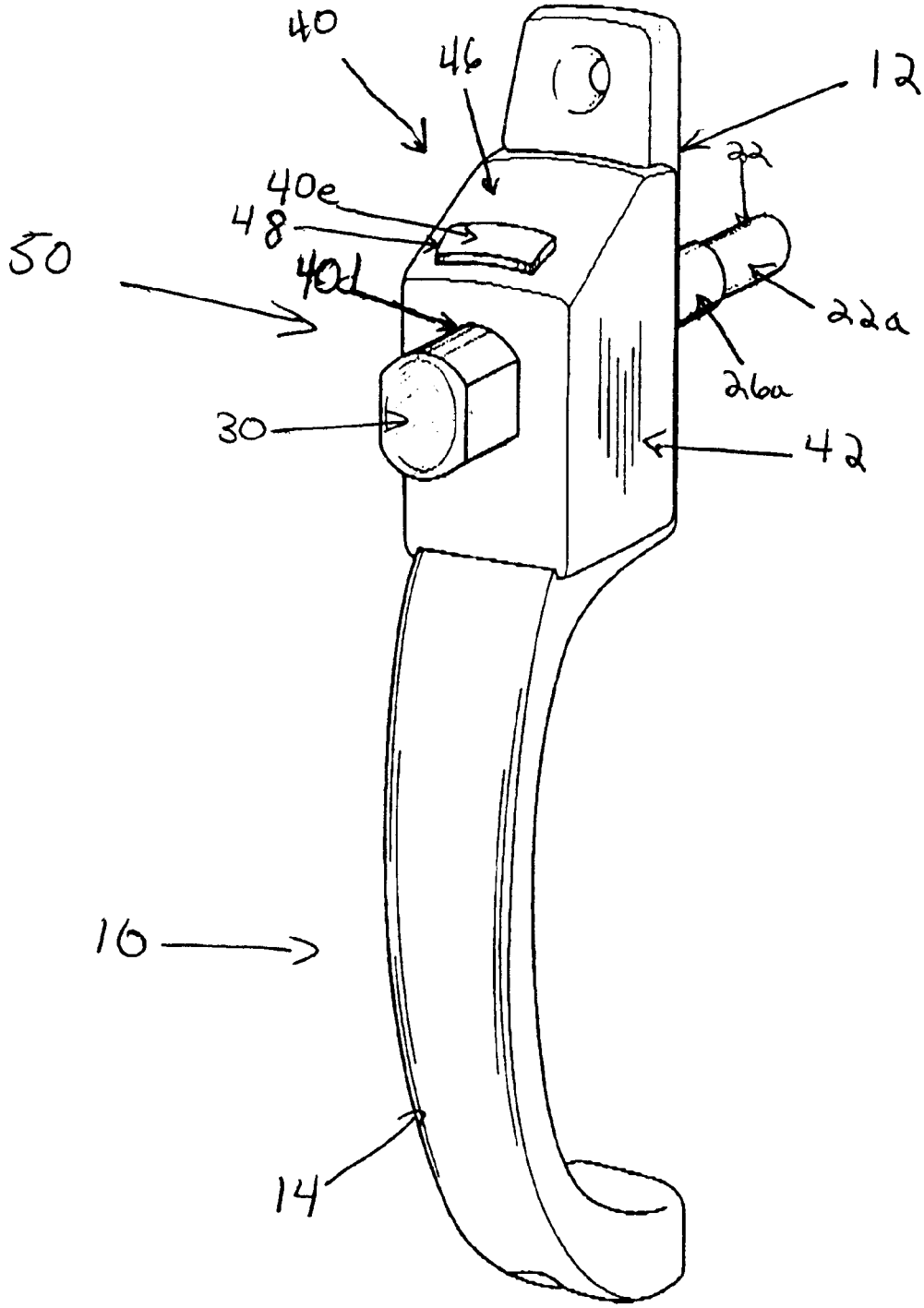
FIG. 4 is a perspective view of an improved sliding door handle.
Figure 5:
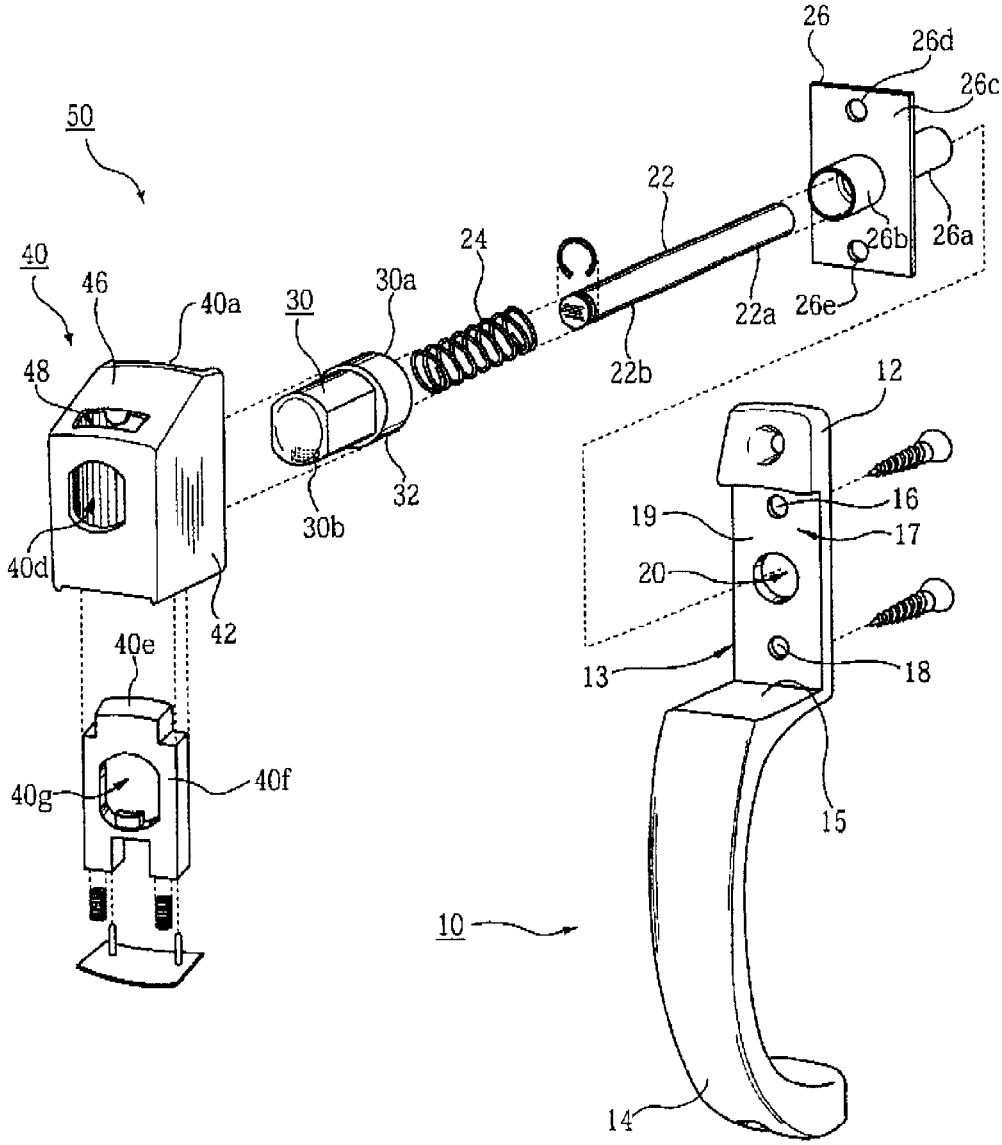
FIG. 5 is an exploded perspective view of an improved sliding door handle.
Figure 6:
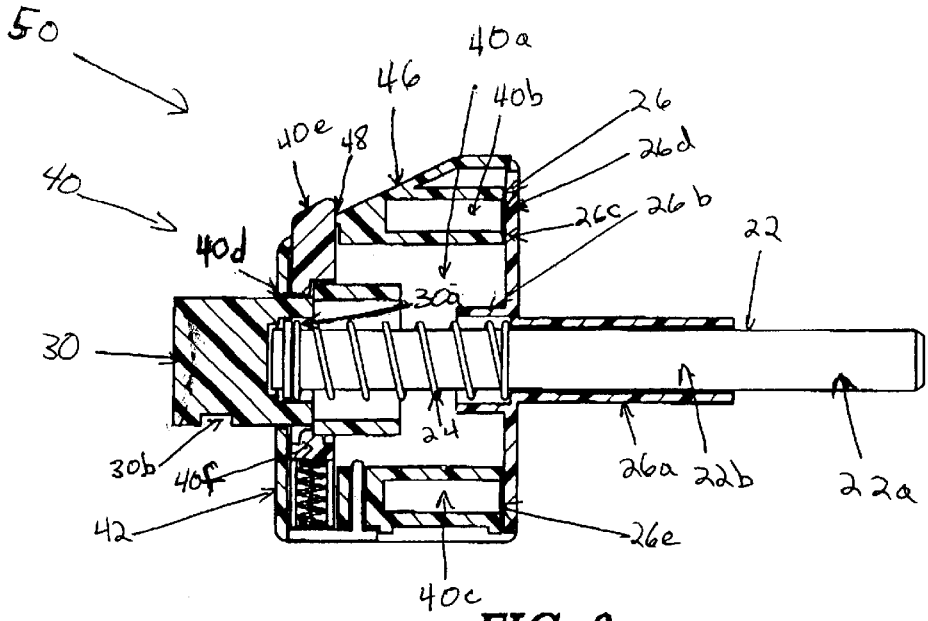
FIG. 6 is a cross sectional view of the push button assembly of the improved sliding door handle in an unlocked position.
Figure 7:
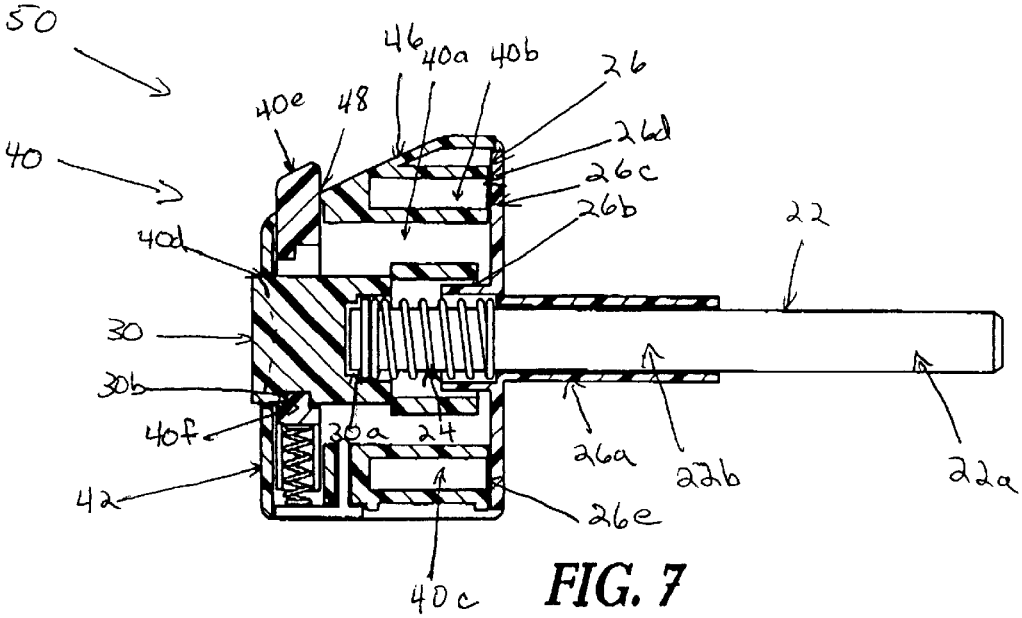
FIG. 7 is a cross sectional view of the push button assembly of the improved sliding door handle in a locked position.

The handle assembly 10 is comprised of an upper handle section 12 and a lower handle section 14. The upper handle section 12 is recessed so as to incorporate push button assembly 40. The upper handle section 12 includes a seat 13 for receiving the push button assembly 40. The seat 13 has a shape complementary to that of the push button assembly 40. The seat 13 further includes a first horizontal section 15 and a fist vertical section 17. The first vertical section 17 has a retaining section 19 and a through-hole opening 20 for securing push button assembly 40, as shown in FIG. 5 The upper handle section 12 also includes two equidistant screw holes 16 and 18 vertically above and below through opening 20 for securing the push button assembly 40 to upper handle section 12 of handle assembly 10.

Push button assembly 40 includes a cylindrical shaft 22 which fits into central hole 20 of upper handle section 12. Shaft 22 is comprised of an outer section 22*a* which acts as a locking pin and an inner section 22*b* which is enclosed in push button assembly 40. Spring 24 fits over inner section 22*b* and is compressible onto stop member 26. Stop member 26 is comprised of an outer section 26*a* that surrounds outer section 22*a* of shaft 22 and an inner section 26*b* that surrounds inner section 22*b* of shaft 22. The inner section 26*b* is integrally comprised of a vertical plate member 26*c* which is secured to upper handle section 12 by screws being inserted through holes 26*d* and 26*e* of plate member 26*c*.

Lower handle section 14 curves out to facilitate the gripping of handle assembly 10.

Push button assembly 40 is comprised of housing member 42 and push button housing 30 which includes a recess 30*b* for receiving locking member 40*f*. Housing member 42 is rectangularly shaped with an internal cavity 40*a* and screw holes 40*b* and 40*c* so as to secure push button assembly 40 to handle assembly 10. Housing member 42 has an opening 40*d* to insert push button housing 30. The top section 46 of housing member 42, has a rectangular opening 48 which contains a vertically movable, rectangular button 40*e* which acts as the release for unlocking handle assembly 50 when depressed. Integral with rectangular button 40*e* and on the bottom portion 44 of opening 40*d* there is a vertically movable locking member 40*f* which moves upwardly to engage recess 30*b*. This activates the locking of handle assembly 50 when locking member 40*f* is in the upper position. Opening 40*g* is aligned with opening 40*d*.

Push button housing 30 has a depression for receiving a person's thumb and is horizontally inserted into opening 40*d* of push button assembly 40. Housing 30 contains an interior chamber 30*a* and locking slot 30*b* on its bottom section 32 which holds aforementioned locking member 40*f* when push button housing 30 is depressed, thus locking handle assembly 50.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. An improved sliding door handle assembly having a spring operated integral push button locking mechanism, comprising:

a) a handle assembly including an upper handle section and a lower handle section, and a push button assembly for use with a pair of sliding doors;

b) said upper handle section including a seat for receiving said push button assembly; said seat having a shape complementary to that of said push button assembly; said seat further including a first horizontal section and first vertical section; said first vertical section having a retaining section and a first through-hole opening for securing said push button assembly;

c) a cylindrical locking pin for insertion into said first through-hole opening;

d) said locking pin being spring-biased to a locking position for locking of said handle assembly and an unlocking position for unlocking of said handle assembly;

e) said lower handle section being curved to facilitate gripping said door handle;

f) said push button assembly including a push button housing and a push button member;

g) said push button assembly having a second through-hole opening for receiving said push button member therethrough and having a locking member for engaging said push button housing;

h) said push button assembly having a recess for receiving said locking member and said locking member being vertically movable between said locking position and said unlocking position; and i) said locking member having a third through-hole opening; said locking member through-hole opening for receiving said push button member therethrough in said unlocking position for unlocking of said handle assembly.

* * * * *